US010982492B1

(12) United States Patent
Gopalan

(10) Patent No.: US 10,982,492 B1
(45) Date of Patent: Apr. 20, 2021

(54) SHOCK ISOLATOR DEVICE AND RELATED METHODS

(71) Applicant: RIME Downhole Technologies, LLC, Benbrook, TX (US)

(72) Inventor: Manoj Gopalan, Fort Worth, TX (US)

(73) Assignee: RIME Downhole Technologies, LLC, Benbrook, TX (US)

( * ) Notice: Subject to any disclaimer, the term of this patent is extended or adjusted under 35 U.S.C. 154(b) by 0 days.

(21) Appl. No.: 16/945,164

(22) Filed: Jul. 31, 2020

(51) Int. Cl.
*E21B 17/07* (2006.01)
*E21B 47/017* (2012.01)
*E21B 47/18* (2012.01)

(52) U.S. Cl.
CPC ..... *E21B 17/07* (2013.01); *E21B 47/017* (2020.05); *E21B 47/18* (2013.01)

(58) Field of Classification Search
CPC ..... E21B 17/07; E21B 17/073; E21B 47/017
See application file for complete search history.

(56) References Cited

U.S. PATENT DOCUMENTS

| | | | | |
|---|---|---|---|---|
| 4,281,726 | A | 8/1981 | Garrett | |
| 4,552,230 | A | 11/1985 | Anderson et al. | |
| 5,083,623 | A | 1/1992 | Barrington | |
| 5,188,191 | A | 2/1993 | Tomek | |
| 6,308,940 | B1 * | 10/2001 | Anderson | E21B 17/073 175/300 |
| 10,407,999 | B2 * | 9/2019 | Pratt | E21B 47/017 |
| 10,443,321 | B2 * | 10/2019 | Cravatte | E21B 17/076 |
| 10,480,260 | B2 | 11/2019 | Brown et al. | |
| 10,704,340 | B2 * | 7/2020 | Pratt | E21B 17/07 |
| 10,753,159 | B1 * | 8/2020 | Ide | E21B 3/00 |

(Continued)

FOREIGN PATENT DOCUMENTS

| | | | | |
|---|---|---|---|---|
| WO | WO-2013050231 | A2 * | 4/2013 | E21B 17/07 |
| WO | 2014022768 | A2 | 2/2014 | |

(Continued)

OTHER PUBLICATIONS

"Spline." Merriam-Webster.com Dictionary, Merriam-Webster, https://www.merriam-webster.com/dictionary/spline, accessed Dec. 17, 2020, 11 pages (Year: 2020).*

(Continued)

*Primary Examiner* — Jennifer H Gay
(74) *Attorney, Agent, or Firm* — Timothy G. Ackerman

(57) ABSTRACT

A shock isolator device for use in a downhole tool attenuates axial shocks to a protected structure and maintains that structure's rotational orientation to the tool while reducing damage to, maintenance costs of, and wear on, the device components. The shock isolator device interposes an internally- and externally-splined key between an internally-splined sleeve on an anti-rotation section and an externally-splined plunger attached to a connector. The key is less wear-resistant than the sleeve or plunger and can be replaced. The meshed sleeve, key, and plunger force the protected structure attached to the connector to maintain its rotational orientation. The sleeve of the anti-rotation system is attached to a shock damper, which damps axial shocks between the plunger and the sleeve, and is connected to a second connector. The shock damper includes a spring assembly and a viscous damper using a piston in an oil-filled cylinder forcing oil through an orifice.

31 Claims, 10 Drawing Sheets

(56) References Cited

U.S. PATENT DOCUMENTS

| | | | | |
|---|---|---|---|---|
| 2009/0023502 | A1* | 1/2009 | Koger | E21B 17/07 464/20 |
| 2012/0247832 | A1* | 10/2012 | Cramer | E21B 47/017 175/40 |
| 2015/0376959 | A1* | 12/2015 | Dinica | E21B 17/07 175/56 |
| 2017/0204684 | A1* | 7/2017 | Cravatte | E21B 17/073 |
| 2017/0328142 | A1* | 11/2017 | Pratt | E21B 47/017 |
| 2018/0171726 | A1* | 6/2018 | Donald | E21B 7/24 |
| 2019/0345778 | A1* | 11/2019 | Pratt | E21B 47/18 |

FOREIGN PATENT DOCUMENTS

| | | | | |
|---|---|---|---|---|
| WO | 2014121377 | A1 | 8/2014 | |
| WO | WO-2016009068 | A1 * | 1/2016 | E21B 17/073 |

OTHER PUBLICATIONS

Lord Corp; PCT/US2013/053418 (filed Aug. 1, 2013); Written Opinion of the International Search Authority (PCT/ISA/237), 6 pp.
QCD Technology Inc.; PCT/CA2014/000089 (filed Feb. 6, 2014); Written Opinion of the International Search Authority (PCT/ISA/237) (dated May 1, 2014), 4 pp.
RIME Downhole Technologies, LLC, "Slickride" 2015 brochure, USA.

* cited by examiner

SHOCK ISOLATOR DEVICE AND RELATED METHODS

BACKGROUND OF THE INVENTION

The invention relates generally to down-hole sensors and equipment and to a system to dampen vibrations that can damage down-hole sensors.

In the drilling of deep bore holes, the rotary drilling technique has become a commonly accepted practice. This technique involves using a drill string which consists of numerous sections of hollow pipe connected together and to the bottom end of which a drill bit is attached. By imparting axial forces onto the drilling bit and by rotating the drill string either from the surface or using a hydraulic motor attached to the drill string, a reasonably smooth and circular bore hole is created. The rotation and compression of the drilling bit causes the formation being drilled to be crushed and pulverized. Drilling fluid is pumped down the hollow center of the drill string through nozzles on the drilling bit and then back to the surface around the annulus of the drill string. This fluid circulation is used to transport the cuttings from the bottom of the bore hole to the surface where they are filtered out and the drilling fluid is recirculated as desired. The flow of the drilling fluid also provides other secondary functions such as cooling and lubricating the drilling bit cutting surfaces and exerts a hydrostatic pressure against the borehole walls to help contain any entrapped gases or fluids that are encountered during the drilling process. To enable the drilling fluid to travel through the hollow center of the drill string, the restrictive nozzles in the drilling bit and to have sufficient momentum to carry cutting and debris back to the surface, the fluid circulation system at the surface includes a pump or multiple pumps capable of sustaining sufficiently high pressures and flow rates, piping, valves and swivel joints to connect the piping to the rotating drill string.

The need to measure certain parameters at the bottom of a bore hole and provide this information to the driller has long been recognized. These parameters include, but are not limited to the temperature, pressure, inclination and direction of the bore hole, vibration levels, inclination, azimuth, toolface (rotational orientation of the drill string), but also include various geophysical and lithological measurements and formation geophysical properties such as resistivity, porosity, permeability, and density as well as in situ formation analysis for hydrocarbon content. The challenge of measuring these parameters in the hostile environment at the bottom of a borehole during the drilling process and conveying this information to the surface in a timely fashion has led to the development of many devices and practices.

It is an advantage to be able send data from the bottom of a bore well to the surface, while drilling, and without the use of wires or cables, and without the continuous and/or frequent interruption of drilling activity. Thus, tools commonly referred to as "measurement while drilling" or "MWD" tools have been developed. Several types of MWD tools have been contemplated in the prior art and are discussed in brief below.

MWD tools may transmit data in several ways, including: creating EM (low frequency radio waves or signals, currents in the earth or magnetic fields) waves to propagate signals through the earth; imparting high frequency vibrations to the drill string which can be used to encode and transmit data to the surface; and creating pressure pulses to encode and transmit data to the surface of the earth from the bottom of a borehole.

MWD tools using pressure pulses can operate in a number of ways, such as: closing or opening a valve in the drill string so as to create a substantial pressure pulse that is detectable at the surface when a particular parameter reaches a preselected or particular value or threshold, or creating a series or group of pulses depending upon the parameter's value, or by using the time between the pressure pulse signals in addition to the total number of pressure pulse signals to encode information. Opening and closing and sensing may be accomplished mechanically or electronically or electromechanically, or by a combination thereof.

An MWD drilling tool may include a pulsing mechanism (pulser) coupled to a power source (e.g, a turbine generator capable of extracting energy from the fluid flow), a sensor package capable of measuring information at the bottom of a well bore, and a control mechanism that encodes the data and activates the pulser to transmit this data to the surface as pressure pulses in the drilling fluid. The pressure pulses may be recorded at the surface by means of a pressure sensitive transducer and the data decoded for display and use to the driller.

A pulser may create pressure pulses in a number of fashions. In one embodiment, a servo mechanism opens and closes the main pulsing mechanism indirectly. U.S. Pat. No. 9,133,950 B2 discloses servo pulser mechanisms, and is incorporated by reference in its entirety. Here, the difference in pressure caused by changes in the fluid flow do most of the work of opening and closing the main valve to generate pulses to transmit data. Such a servo mechanism assisted pulser may also be called a hydraulically assisted pulser.

A hydraulically assisted pulser of a lifting knob type typically has an obstruction, or poppet, used to create a controllable obstruction in an orifice (and a resultant pressure drop thereacross), such hydraulically assisted pulsers are driven by a servo or pilot valve.

In many cases, operators may also desire to use logging-while-drilling (LWD) sensors, which entails including one or more well logging tools downhole into the well borehole as part of the downhole tool. LWD can permit the properties of a formation to be measured during the drilling process. LWD sensors traditionally reside below (downhole or downstream of) the MWD platform to be as close as possible to the bit.

A MWD or LWD platform typically must be locked rotationally (about the longitudinal axis of the drill string) to maintain it in a known/fixed rotational orientation to elements of the drill string (such as the drill bit). This permits the platform to accurately measure/record data such as inclination and direction of the bore hole, inclination, azimuth, and toolface (rotational orientation of the drill string).

A problem encountered in MWD and LWD systems is that the drilling process involves creating axial vibrations and shocks that can interfere with signal transmission and equipment damage of signals generated by the sensors. Another problem encountered in MWD and LWD systems is that the drilling process involves rotation, slow, steady, fast, and jerky, of the drill string, and the MWD and LWD systems must maintain the known/fixed rotation despite these. MWD and LWD systems are typically mechanically fixed to and supported by a part of the drill string that experiences these mechanical vibrations and shocks.

Devices known as dampeners have been developed in efforts to address these problems. Dampeners and related peripheral technologies have been described in US Patent Publication Nos. US 20170328142 A1 and International Patent Application No. WO 2014121377 A1, each of which is incorporated herein by reference in its entirety.

SUMMARY OF THE INVENTION

A new and improved apparatus, system, and method of use are presented that allow a shock isolator device, as incorporated into a drilling system, to attenuate shocks along a longitudinal axis of the drilling system and resist torsional forces about the longitudinal axis of the drilling system, using an anti-rotation section, and a dampener section as a part of an MWD/LWD tool assembly. In an embodiment, the shock isolator device includes a main sleeve having a main cavity, a plunger to be attached to other parts of the tool assembly and that can move at least partly within said main cavity longitudinally, a spline key that engages with main sleeve and the plunger, where the spline key is shorter than the main cavity and includes both an interior spline and an exterior spline, each longitudinally-aligned, connected by a cylindrical core section, and a shock damper connecting the main sleeve and the plunger that acts to damp longitudinal shock therebetween. The main sleeve includes a longitudinally-aligned sleeve spline extending into the main cavity and the plunger includes a longitudinally-aligned plunger spline. Between the sleeve spline and the plunger spline is the spline key, with the interior spline engaging the plunger spline and the exterior spline engaging the sleeve spline. In an embodiment, the spline key in the shock isolator device restricts the main sleeve from axial rotation relative to the plunger, thus maintaining orientation of the protected portion of the tool assembly. In an embodiment, the dampener section uses a spring/damper system to attenuate shocks along the longitudinal axis.

In an embodiment, the plunger incudes a channel or flowpath running axially/longitudinally between the plunger's connector end and the plunger's sleeve end. The plunger also includes a hydraulic connection on the connector end and the shock damper includes a second hydraulic connection. The shock isolator may form a hydraulic connection along said channel/flowpath between said the two hydraulic connections.

In an embodiment, the plunger incudes a channel running axially/longitudinally between the plunger's connector end and the plunger's sleeve end. The channel may form an electronics pathway or electromagnetic communications pathway between the plunger connector end and the sleeve end. In an embodiment, each of the plunger's connector end and sleeve end include a plug or electrical connection or part of a receiver/transmitter pair, and the channel may include a wire assembly connecting the plugs.

In an embodiment, the interior spline includes a plurality of spline projections facing the interior of the spline key, those interior spline projections each having two opposing bearing faces that are flat and fully or substantially parallel to one other. In a similar fashion, the plunger includes a plurality of plunger spline slots, those plunger spline slots each having two opposing plunger bearing faces that are flat and fully or substantially parallel to one other. In this fashion, the interior spline projections of the spline key may match and fully mesh with the spline slots of the plunger. In addition, the flat bearing faces reduce wear and bearing pressures thereon, increasing usable worklife of the parts.

In an embodiment, the exterior spline includes a plurality of spline projections facing the exterior of the spline key, those exterior spline projections each having two opposing bearing faces that are flat and fully or substantially parallel to one other. In a similar fashion, the main sleeve includes a plurality of sleeve spline slots, those sleeve spline slots each having two opposing sleeve bearing faces that are flat and fully or substantially parallel to one other. In this fashion, the exterior spline projections of the spline key may match and fully mesh with the spline slots of the main sleeve. In addition, the flat bearing faces reduce wear and bearing pressures thereon, increasing usable worklife of the parts.

In an embodiment, both the interior spline and the exterior spline include sets of substantially flat bearing faces, where each set of those bearing faces includes bearing faces fully or substantially parallel to one another, and where one or more of the bearing faces of a set of bearing faces of the interior spline is fully or substantially parallel to one or more of the bearing faces of a set of bearing faces of the exterior spline.

In an embodiment, the interior spline includes a number of interior spline projections, and the exterior spline includes a number of exterior spline projections, where the interior spline projections are located radially inward of the exterior spline projections. In an embodiment, the interior spline projections are located radially offset of the exterior spline projections.

In an embodiment, the spline key and its mating structures, such as the main sleeve and plunger, have differing resistance to wear. This may be to facilitate sacrificing one part to protect the other, perhaps more expensive, part. In a particular embodiment, the spline key is formed of a material less wear-resistant than the main sleeve. The spline key may also be formed of a material less wear-resistant than the plunger or plunger shaft. In an embodiment, the sleeve spline may be formed of a material more wear-resistant than the exterior spline of the spline key. In a particular embodiment, the spline key is manufactured to be less wear-resistant than the main sleeve or plunger or, conversely, one or both of the main sleeve or plunger are manufactured to be more wear-resistant than the spline key. In an embodiment, the main sleeve or its sleeve spline, and the plunger or its plunger spline, may be a machined component that is heat-treated and surface-hardened, such as by being boronized or nitrided, while the spline key is a machined component that is heat-treated but not surface-hardened.

In an embodiment, the interior spline and exterior spline of the spline key are connected by a cylindrical core forming webs between the exterior spline projections and the interior spline projections, and the core and projections may be monolithically formed by known manufacturing processes, such as casting, forging, or additive manufacturing processes such as 3D printing.

In an embodiment, the spline key is axially located on said plunger, and the plunger includes a snap ring and a shoulder or key stop to axially locate the spline key thereon. In an embodiment, the shock damper includes a piston spring assembly and/or a viscous damper, and in a particular embodiment may include both a piston/spring assembly and viscous damper. In an embodiment, the piston/spring assembly includes a piston axially locked to the plunger, the piston set between spring structures both upward and downward thereof, with opposing ends of the springs fixed so as to absorb both upward and downward longitudinal/axial shocks. In embodiment, the shock damper includes a dampener section forming a cylindrical bore containing a fluid, such as an oil, and a piston axially fixed to the plunger such that the piston is movable within and relative to said cylindrical bore and creates a narrow orifice between said piston and said bore for passage of said oil. In this manner, the piston's movement in the oil acts as a damper by dissipating energy by forcing oil through a restriction between the bore and the piston. The piston may have a bearing facing the bore that can include orifice structures or may be formed with close tolerances so as to leave a small, restrictive, cylindrical orifice between the piston's radially-outward surface and the inner surface of the cylindrical bore.

In an embodiment, the anti-rotation tool may be joined to a shock damper including a piston spring assembly and a viscous damper. The plunger may have a lower spring inserted over the shaft end and against a shoulder on the main sleeve, and then joined to a piston extension abutting the lower spring on the piston's upper side, and an upper spring placed over the piston extension shaft, the upper spring abutting the piston's upper side, and a receiver assembly placed over the springs, piston, and piston extension, and with a shoulder abutting the upper side of the upper spring.

In an embodiment, a shock isolator device attenuates shocks along a longitudinal axis of the drilling system and resists torsional forces about the longitudinal axis of the drilling system by an anti-rotation tool having a spline key interposed between and engaging both a main sleeve and a plunger (for resisting torsional forces), and a spring/damper system including a piston spring assembly with a piston/orifice/oil-filled cylindrical bore assembly (for reducing shock amplitude and dissipating shock energy). In an embodiment, a shock isolator device resists torsional forces, such as those arising from rotational inertia tending to further rotate or oscillate a protected mass, by connecting the main sleeve to one of the shock source and the protected mass, and the plunger to the other of the shock source and the protected mass, with the spline key interposed between and engaging both the main sleeve and a plunger.

In an embodiment, a shock isolator device resists axial/longitudinal forces by connecting the shock damper to one of the shock source and the protected mass, and the plunger to the other of the shock source and the protected mass. The plunger and the main sleeve are each connected to the shock damper, the former to the piston extension and the latter to the receiver assembly retaining the springs and the oil. A protected mass may include a portion of an MWD tool such as one or more of an instrument section, battery section, servo pulser, EM transmitter assembly, or the like. A shock source may include one or more of a main pulser, a drill bit, or drill collar, or tool or drill string elements transmitting shocks experienced by the tool or drill string.

In an embodiment, an anti-rotation tool may be assembled by sliding an interior spline of a spline key having an interior spline, having a plurality of spline projections facing the interior thereof, over a plunger spline on a plunger, the plunger having a plurality of plunger spline slots, so as fully mesh the interior spline to the plunger spline. One end of the spline key is seated on a shoulder formed on the plunger shaft, and the other end fixed axially to the plunger by a snap ring or other locking device. Then the plunger and spline key are inserted into a main sleeve, where the exterior spline of the spline key, having a plurality of spline projections facing the exterior of the spline key, is slid into a sleeve spline of the main sleeve, having a plurality of sleeve spline slots, so as to fully mesh the exterior spline to the sleeve spline.

In an embodiment, repair/maintenance of an anti-rotation tool of a shock isolator device includes removing a main sleeve by sliding the sleeve spline thereof off of the exterior spline of the old spline key, the old spline key being less wear-resistant than the main sleeve, and then removing a snap ring (or other axial-fixing structure) retaining the old spline key on the plunger, and then removing the old spline key by sliding the interior spline of the old spline key off of the plunger spline of the plunger. The repair further includes replacing the old spline key by sliding the interior spline of a new spline key onto the plunger spline of the plunger until it seats against a shoulder/key stop, then fixing into place a snap ring (or other axial-fixing structure) retaining the new spline key on the plunger, then reinserting the main sleeve by sliding the sleeve spline thereof onto the exterior spline of the new spline key, the new spline key being less wear-resistant than the main sleeve.

These, together with other objects of the invention, along with the various features of novelty which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

DETAILED DESCRIPTION

Figure 1:
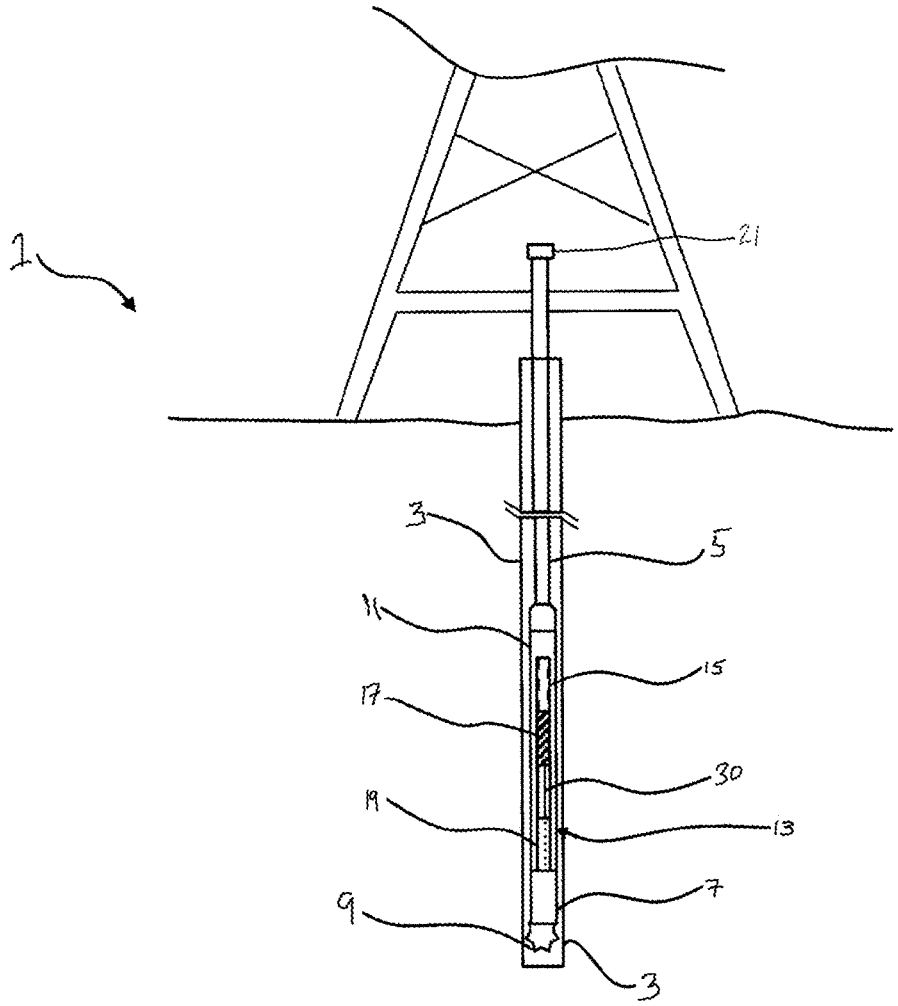
FIG. 1 is a representative view and partial cutaway of parts of the surface and downhole portions of a drilling rig.

Referring now to the drawings and specifically to FIG. 1, there is generally shown therein a simplified sketch of the drilling system 1 used in the rotary drilling of boreholes. A drill string 5 used to drill bore 3 is made up of multiple sections of drill pipe that are secured to the surface and extend into bore 3 and include mud motor 7, and drill bit 9 at the bottom thereof. The entire drill string 5 is rotated while drill string 5 is lowered into the bore and controlled axial compressive loads are applied. The bottom of drill string 5 is attached to multiple drilling collars 11, which are used to stiffen the bottom of drill string 5 and add localized weight to aid in the drilling process. A measurement while drilling (MWD) tool assembly 13 is generally depicted attached to the bottom of drill collars 11 and drill bit 9 and mud motor 7 are attached to the bottom of MWD tool assembly 13.

The drilling fluid or "mud" is forced to flow into the top of drill string 5. The fluid flows through drill string 5, through drill collars 11, through MWD tool assembly 13, through mud motor 7 and drill bit 9. The drilling fluid then returns to the surface by traveling through the annular space between the outer diameter of drill string 5 and bore 3.

MWD tool assembly 13 includes within its inner diameter main pulser 19, servo pulser 17, shock isolator 30, and instrument module 15, which may include a battery section. Main pulser 19 is hydraulically connected to servo pulser 17 at one end to create a path for drilling fluid between those components. The other end of main pulser 19 is in contact with the internal drilling fluid column within the inner diameter of MWD tool assembly 13. Shock isolator 30 is connected to and between the adjacent ends of servo pulser 17 and main pulser 19 and hydraulically links both pulser devices. Instrument module 15 is attached to the far end of servo pulser 17. MWD tool assembly 13 communicates with MWD signal processor 21 on the surface.

Figure 2A:
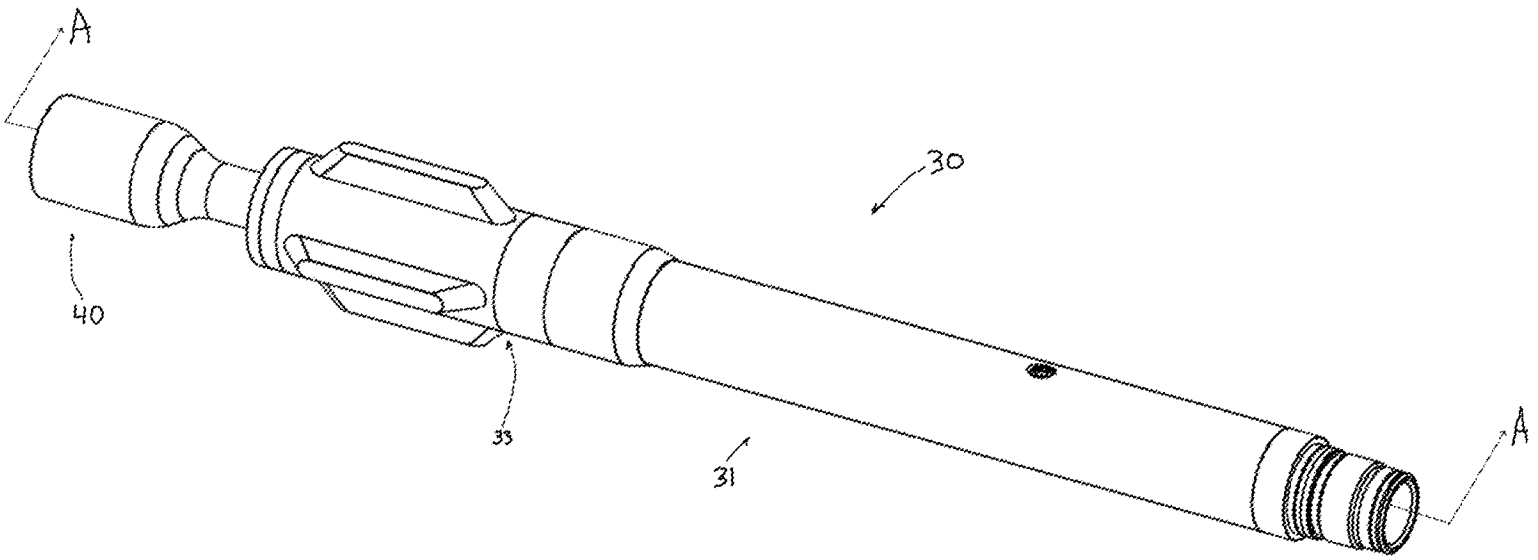
FIGS. 2A & 2B are perspective views of two embodiments of a shock isolation device.
Figure 3A:
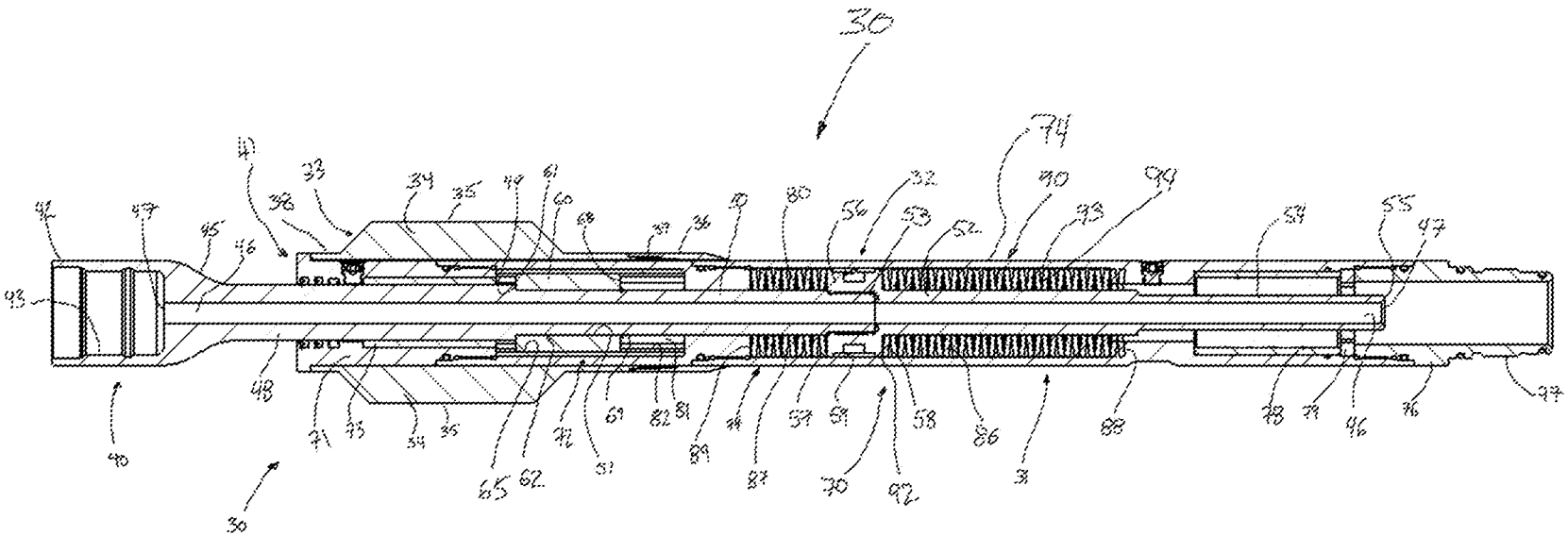
FIG. 3A is a cross-sectional view of the device of FIG. 2A along section A-A.
Figure 4:
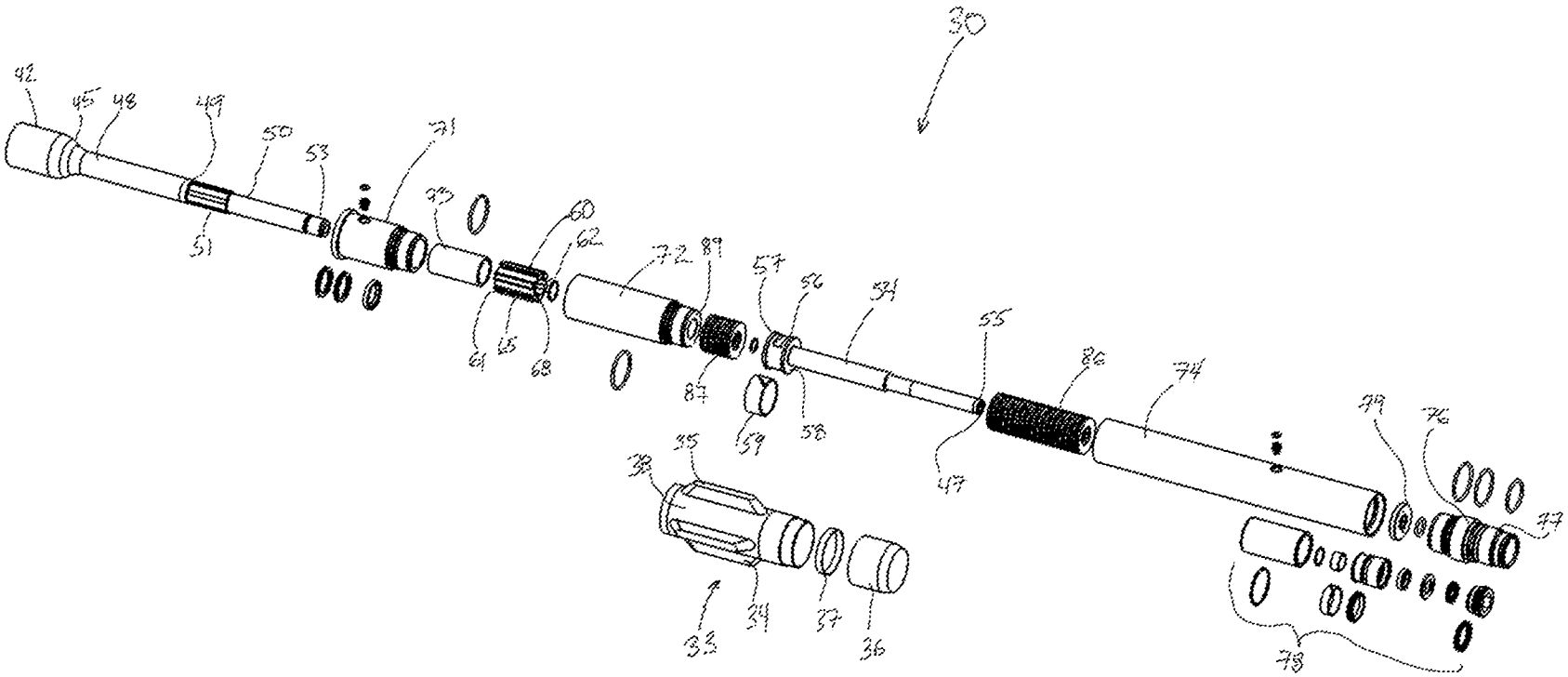
FIG. 4 is a perspective exploded view of the shock isolation device of FIG. 2A.
Figure 5A:
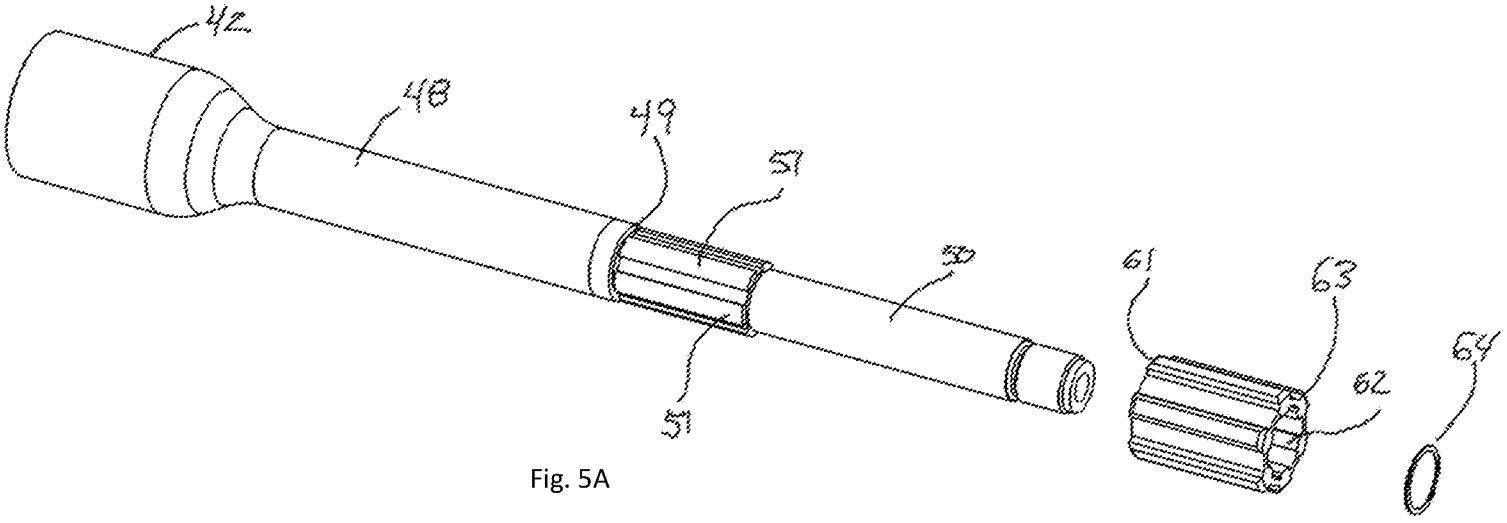
FIGS. 5A & 5B are perspective views of an embodiment of a plunger assembly showing mounting of an embodiment of a spline key.
Figure 5B:
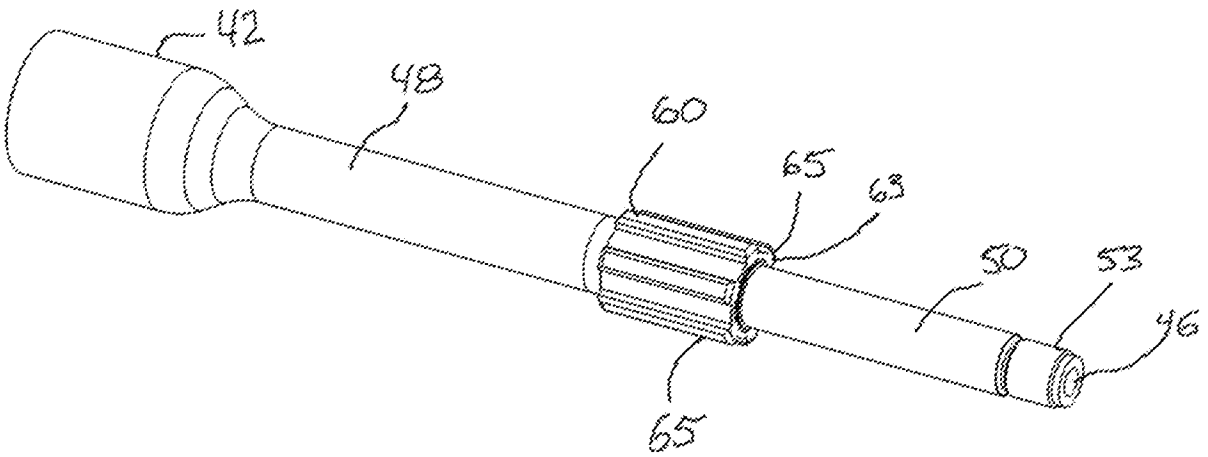

Referring now to FIGS. 2A, 3A, and 4 and with reference to FIGS. 5A & 5B, a first embodiment of shock isolator device 30 includes anti-rotation assembly 41, shock damper 31, and centralizer assembly 33.

In an embodiment, anti-rotation assembly 41 includes plunger assembly 40, seal bulkhead 71, and splined bulkhead 72.

Plunger assembly 40 includes bottom connector 42 having interior threads 43 at the bottom end of plunger assembly 40 for connecting to other drill string or MWD tool elements. Within bottom connector 42 is orifice 47 leading to flow passageway 46 through bearing shaft 48, and key shaft 50 to shaft connection 53 at the bottom end of plunger assembly 40. Bottom connector 42 transitions at neck 45 to bearing shaft 48, which connects to key shaft 50 and then to shaft connection 53. Plunger assembly 40 enters seal bulkhead 71 at bearing shaft 48, and is engaged with radial bearing 73, which is attached to seal bulkhead 71. Plunger assembly 40 narrows at the transition between bearing shaft 48 and key shaft 50 to form a shoulder, key stop 49. Key shaft 50 includes axially-aligned shaft splines 51. Key 60 includes radially inner and axially-aligned key splines 62, radially and axially-aligned outer key splines 65, stop end 61 at its lower end and snap ring end 68 at its upper end. Inner key splines 62 are engaged with shaft splines 51, where key 60 is as long or longer than shaft splines 51. Key 60 is axially fixed on plunger assembly 40 and is pressed to key stop 49 at stop end 61 secured at snap ring end 68 by snap ring 69.

Splined bulkhead 72 includes key cavity 81, including axially-aligned receiver splines 82. Splined bulkhead 72 is connected at its lower end to seal bulkhead 71 and is open at that lower end and closed at its upper end by lower spring shoulder 89. Key shaft 50 extends through lower spring shoulder 89 (with seals, not shown). Receiver splines 82 are engaged with outer key splines 65 of key 60 with key 60 within key cavity 81; key cavity 81 and receiver splines 82 are both longer axially than key 60 to as to permit key 60 (and thus plunger assembly 40) to move slidably and axially within splined bulkhead 72 while remaining engaged therewith and not permitting rotation therebetween.

In an embodiment, shock damper 31 includes dampener section 70 and top connector 76. Dampener section 70 includes viscous damper 32, piston-spring assembly 90, receiver assembly 74, and pressure compensator 78.

Receiver assembly 74 attaches at its open upper end to splined bulkhead 72 and includes cylindrical bore 80 open at its upper end with grease trap 79 near its upper end, and supporting pressure compensator 78 below grease trap 79, and upper spring shoulder 88 below pressure compensator 78. Receiver assembly 74 attaches at its upper end to top connector 76.

Viscous damper 32 includes spring shaft 52 having piston 56 at its lower end and extending upward to compensator shaft 54 to tip 55 having orifice 47 therein. Piston 56 connects to connection 53 of plunger assembly 40. Piston 56 includes lower face 57 and upper face 58 and radial bearing 59. Flow passageway 46 extends from orifice 47 through spring shaft 52 and compensator shaft 54 and piston 56 to connect to flow passageway 46 of plunger assembly 40. The exterior of top connector 76 includes threads 77 for connecting to other drill string or MWD tool elements. Attachment of receiver assembly 74 to splined bulkhead 72 closes off the lower end of cylindrical bore 80 at lower spring shoulder 89. Pressure compensator 78 closes off the upper end to permit isolation of oil therein without intrusion of drilling mud or other contaminants. Compensator shaft 54 passes through pressure compensator 78 (with seals, not shown) to connect flow passageway 46 to top connector 76 and to plunger assembly 40. Piston 56 and bearing 59 form a close tolerance damper orifice 92 between bearing 59 and cylindrical bore 80. Thus axial movement of piston 56 relative to cylindrical bore 80, as caused by forces applied between bottom connector 42 and top connector 76, compresses the oil in cylindrical bore 80 on one side of piston 56 and forces it to pass through damper orifice 92 to the other side of piston 56 and cylindrical bore 80, dissipating energy in dampener section 70 of shock isolator 30.

Piston-spring assembly 90 includes spring shaft 52 having piston 56 at its lower end and lower face 57 and upper face 58. Piston 56 connects to connection 53 of plunger assembly 40. Lower spring 87 is contained at its upper end by lower face 57 and its lower end by lower spring shoulder 89 of splined bulkhead 72. Upper spring 86 is contained at its lower end by upper face 57 and its upper end by upper spring shoulder 88 of receiver assembly 74. In an embodiment, lower spring 87 and upper spring 86 are formed by stacked Belleville washers, here depicted representatively by lower washer 93 and lower washer 94. Washer stacked to form lower spring 87 and upper spring 86 may be stacked in the same direction (not shown) or in opposing pairs as lower washer 93 and lower washer 94.

Centralizer assembly 33 includes body 38 supporting a set of radial-extending fins 34 having fin edges 35, gasket 37, and locking ring 36, and mounts up to a shoulder at the lower end of seal bulkhead 71.

Figure 2B:
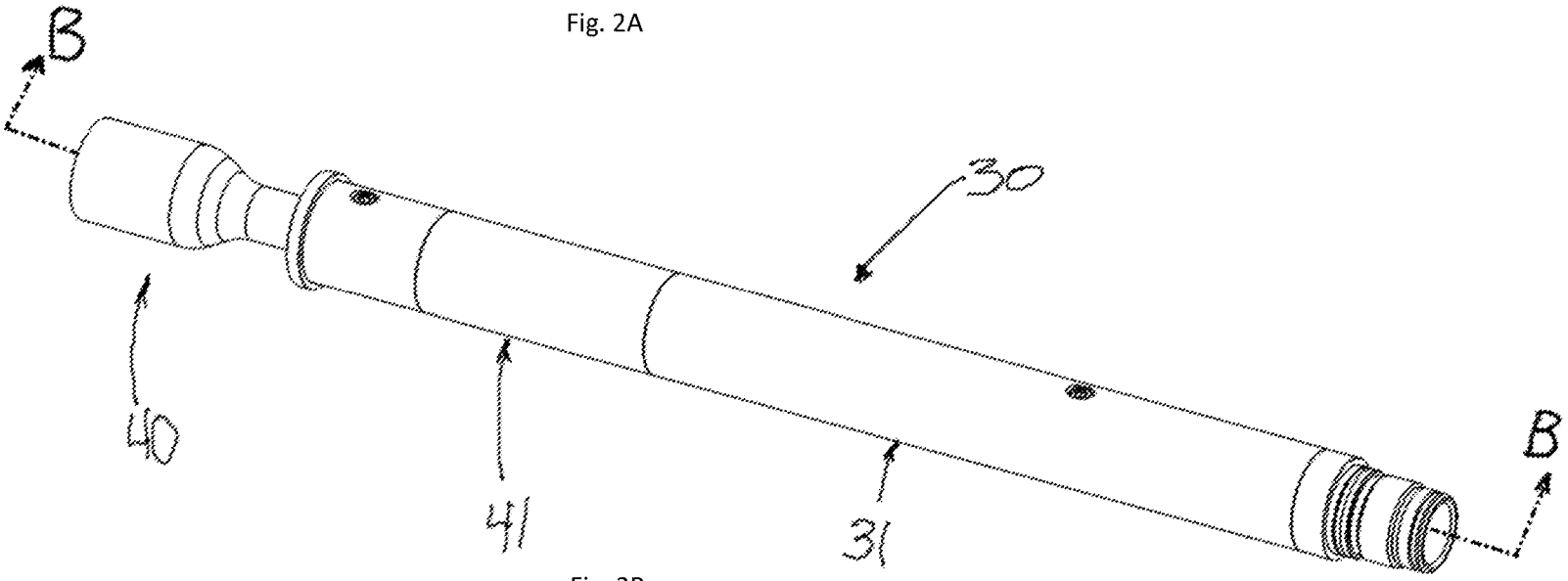
Figure 3B:
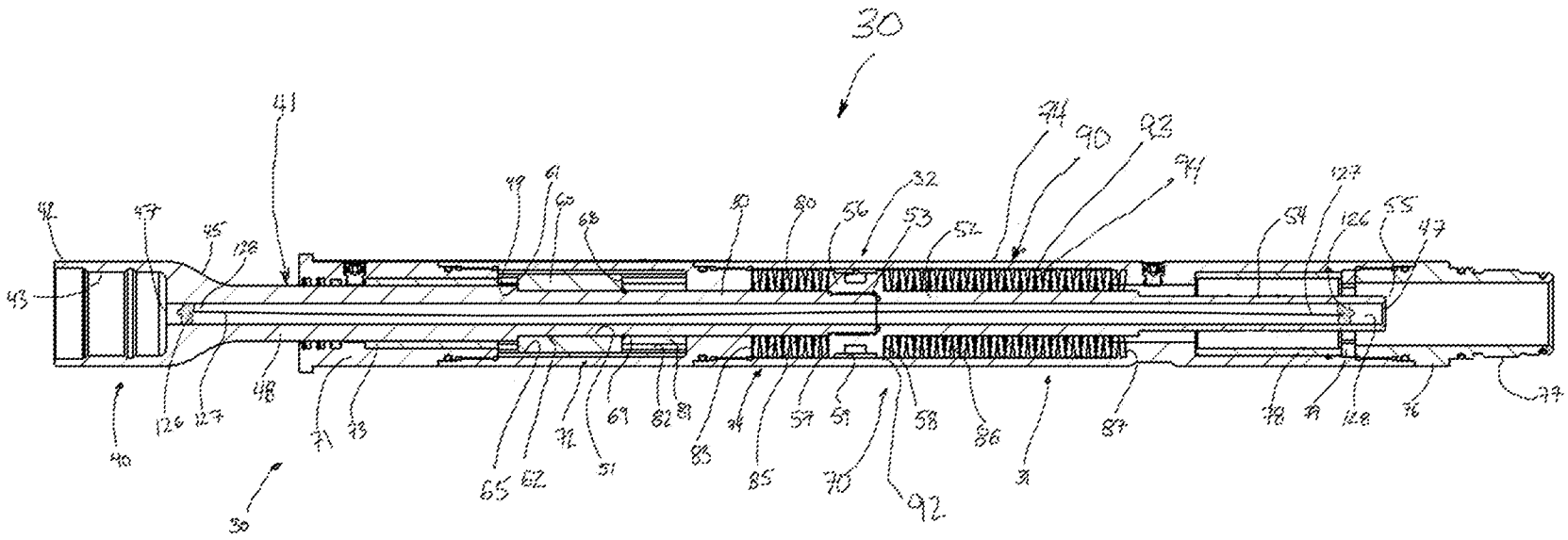
FIG. 3B is a cross-sectional view of the device of FIG. 2B along section B-B.

Referring now to FIGS. 2B and 3B and with reference to FIGS. 5A & 5B, a second embodiment of shock isolator device 30 includes anti-rotation assembly 41 and shock damper 31. This embodiment is the same as that of FIGS. 2A and 3A except for the following: centralizer assembly 33 is omitted; electronics pathway 128 replaces flow passageway 46; plug 126 is fixed in electronics pathway 128 near orifice 47 of bottom connector 42; plug 126 is fixed in electronics pathway 128 near orifice 47 of top connector 76; and wire assembly 127 extends through electronics pathway 128 to form a connection between plugs 126 for transmitting electrical power or communications signals therebetween. In other embodiments (not shown centralizer assembly 33 could be omitted from the embodiment of FIGS. 2A and 3A or added to the embodiment of FIGS. 2B and 3B.

Figure 6A:
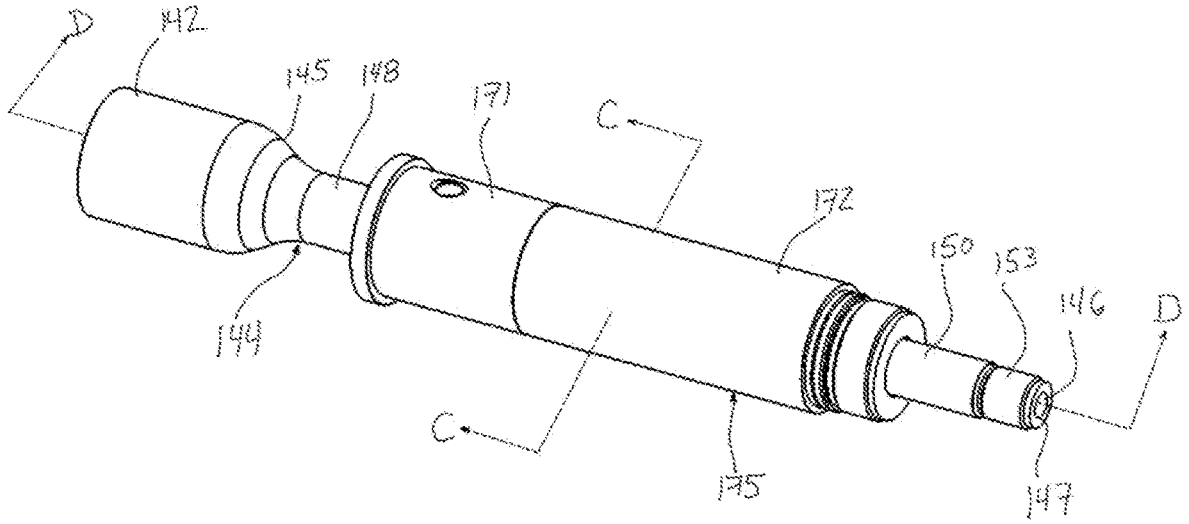
FIG. 6A is a perspective view of an anti-rotation tool.
Figure 6B:
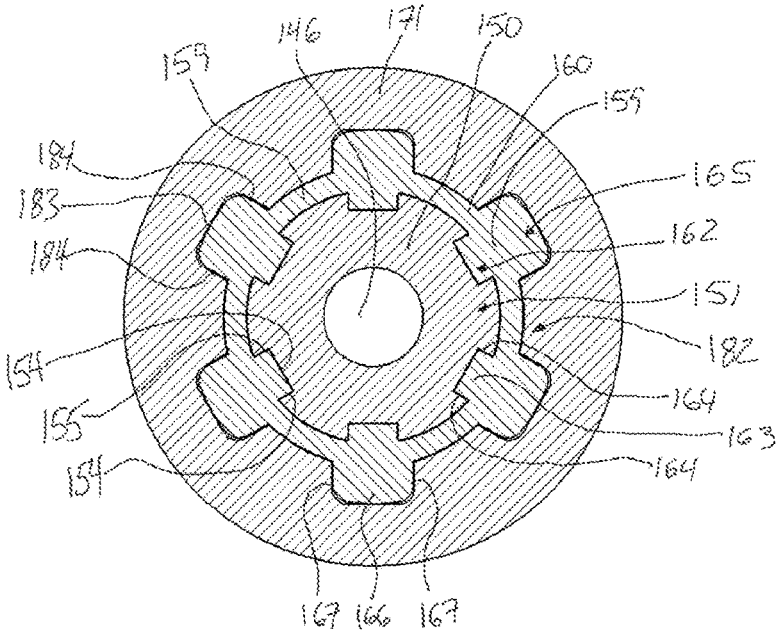
FIG. 6B is a cross-sectional view of the tool of FIG. 6A along section C-C.
Figure 6C:
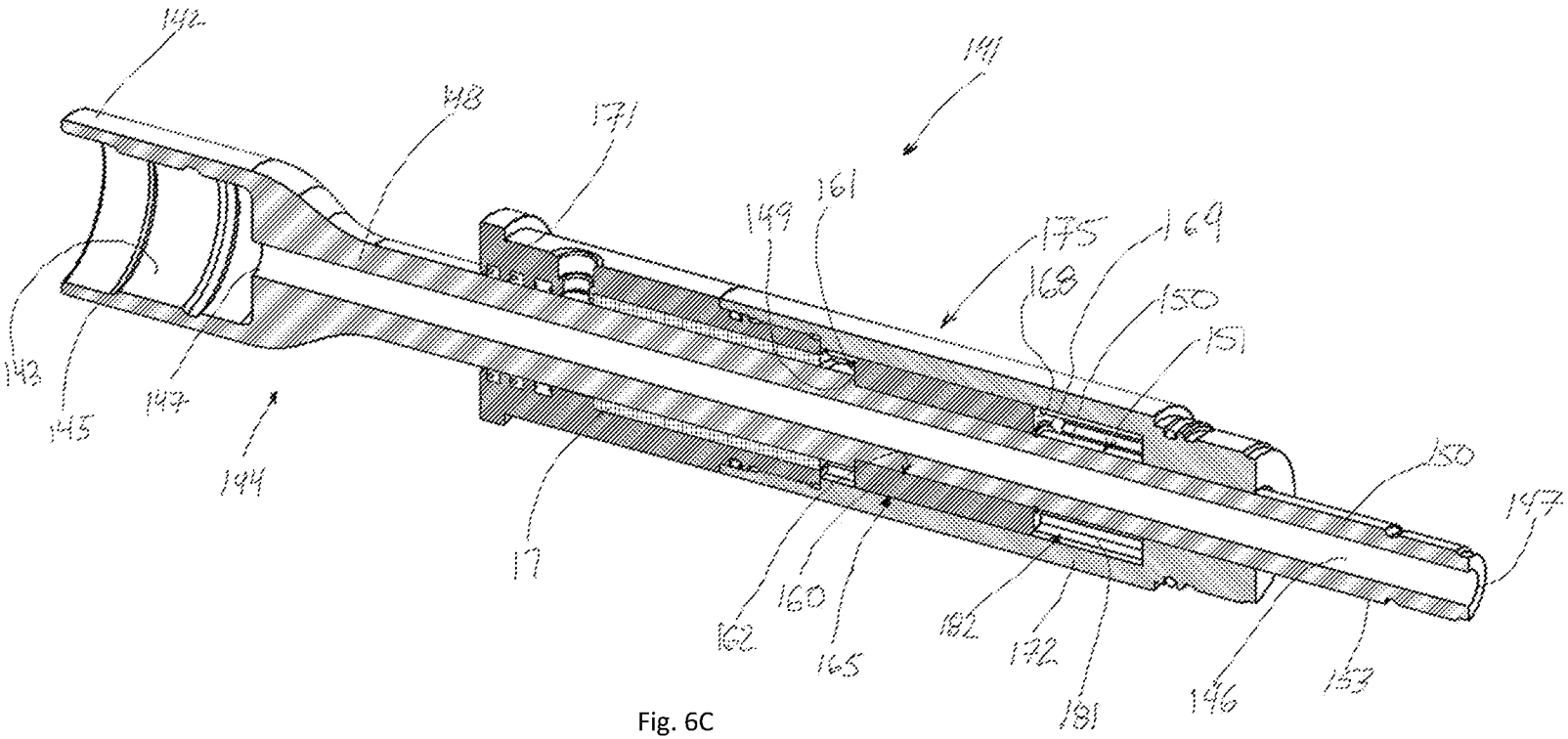
FIG. 6C is a cross-sectional view of the tool of FIG. 6A along section D-D.

Referring now to FIGS. 6A, 6B, and 6C, an embodiment of anti-rotation system 141 includes plunger 144, main sleeve assembly 175, and spline key 160.

Plunger 144 includes connector 142, with threads 143, located at plunger connector end 145 for connecting to other drill string or MWD tool elements. Within connector 142 is orifice 147 leading to channel 146 through bearing shaft 148, and splined shaft 150 to orifice 147 at sleeve end 153 at the top end of plunger 144. Connector 142 connects to bearing shaft 148, which connects to splined shaft 150 and then to sleeve end 153. Plunger 144 narrows at the transition between bearing shaft 148 and splined shaft 150 to form a shoulder, key stop 149. Splined shaft 150 includes axially-aligned plunger spline 151. Plunger spline 151 includes a set of radially-spaced plunger spline slots 154 formed into splined shaft 150, plunger spline slots 154 including opposing plunger slot bearing faces 155. Plunger slot bearing faces 155 may be fully or substantially flat and parallel to one another.

Spline key 160 includes radially inner and axially-aligned interior spline 162, radially and axially-aligned exterior spline 165, cylindrical core 159 attaching interior spline 162 to exterior spline 165, stop end 161 at its lower end, and snap ring end 168 at its upper end. Interior spline 162 includes a set of radially-spaced interior spline projections 163 extending radially inwardly from cylindrical core 159, including opposing interior bearing faces 164. Interior bearing faces 164 may be fully or substantially flat and parallel to one another. Exterior spline 165 includes a set of radially-spaced exterior spline projections 165 extending radially outwardly from cylindrical core 159, including opposing exterior bearing faces 167. Exterior bearing faces 167 may be fully or substantially flat and parallel to one another. Cylindrical core 159 also connects radially-adjacent interior spline projections 163 to one another and adjacent exterior spline projections 166 to one another. Spline key 160 is axially fixed on plunger 144 and is pressed to key stop 149 at stop end 161 and secured at snap ring end 168 by snap ring 169.

Main sleeve assembly 175 includes seal bulkhead 171 and splined bulkhead 172. Seal bulkhead 71 is at the lower end of main sleeve assembly 175 and bearing shaft 148 of plunger 144 enters seal bulkhead 71 and engages with radial bearing 173, which is attached to seal bulkhead 171. Splined bulkhead 172 includes main cavity 181, including axially-aligned sleeve spline 182. Splined bulkhead 172 is connected at its lower end to seal bulkhead 171 and is open at that lower end and closed at its upper end, but with splined shaft 150 extending therethrough (with seals, not shown). Sleeve spline 182 includes a set of radially-spaced sleeve spline slots 183 formed into splined bulkhead 172, sleeve spline slots 183 including opposing sleeve spline bearing faces 184. Sleeve spline bearing faces 184 may be fully or substantially flat and parallel to one another.

Interior spline 162 is engaged with plunger spline 151, where spline key 160 is as long or longer than plunger spline 151. That engagement causes interior spline projections 163 to extend radially inwardly into plunger spline slots 154, causing interior bearing faces 164 to bear upon plunger slot bearing faces 155. Exterior spline 165 is engaged with sleeve spline 182, where spline key 160 is shorter than sleeve spline 182. That engagement causes exterior spline projections 167 to extend radially outwardly into sleeve spline slots 183, causing exterior bearing faces 167 to bear upon sleeve spline bearing faces 184. In an embodiment, the projections and slots above mesh fully with only very small tolerances. The flat, substantially or fully parallel bearing faces reduce applied pressures and wear thereon.

Main cavity 181 and sleeve splines 182 are both longer axially than spline key 160 to as to permit spline key 160 (and thus plunger 144) to move slidably and axially within main sleeve assembly while remaining engaged and not permitting rotation therebetween.

Figure 7:
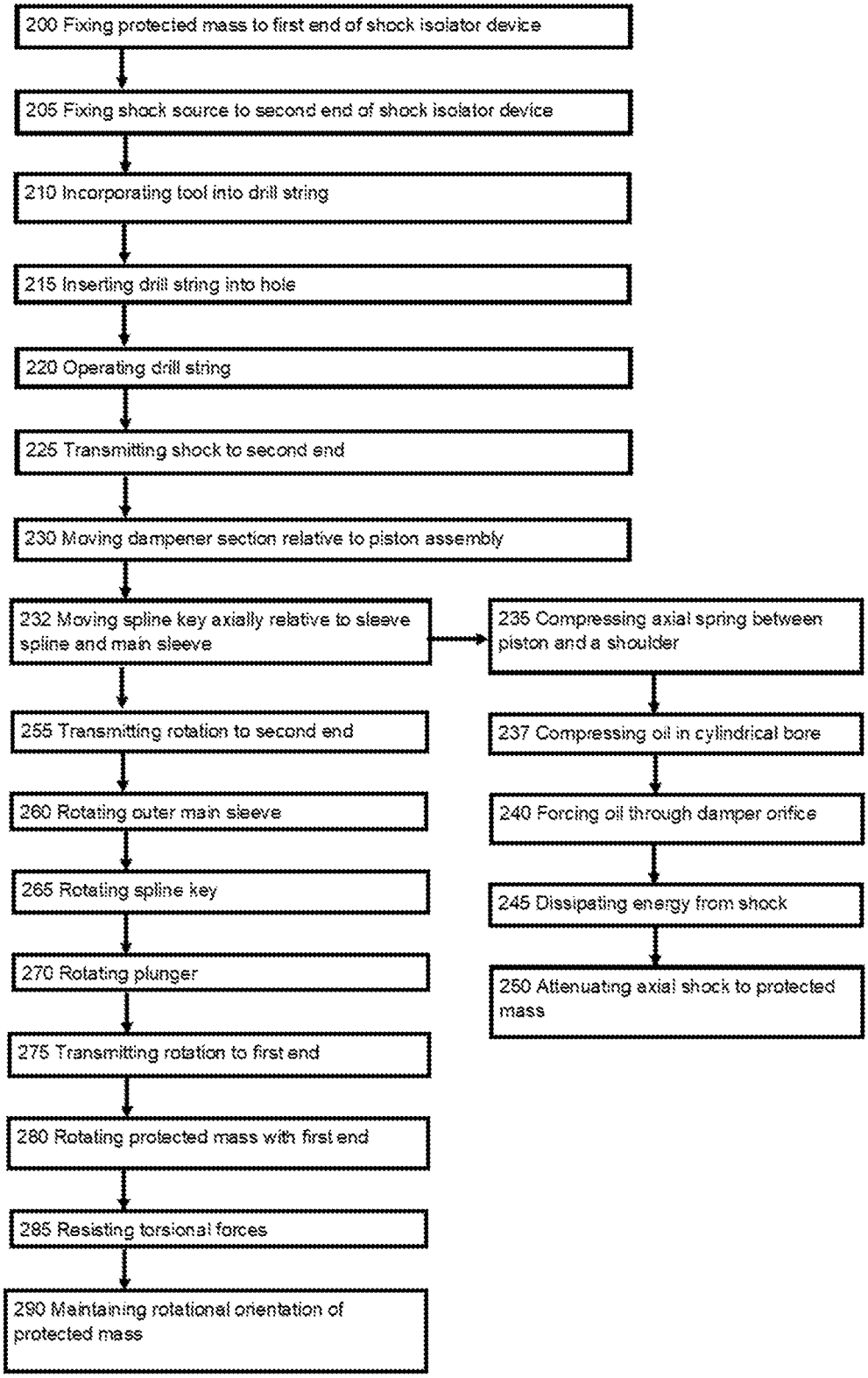
FIG. 7 describes a method of operation of an embodiment of the shock isolation device.

Turning to FIG. 7, an embodiment of a method of operation of the invention includes the following steps. Step 200 is rotationally and axially fixing a protected mass to a first end, such as the plunger, of a shock isolator device having an anti-rotation system to resist torsional forces and a shock damper system to reduce axial shock. Step 205 is rotationally and axially fixing a shock source to a second end of the shock isolator device, where that second end may be the top connector of a shock damper. Step 210 is incorporating a tool containing the protected mass and shock source into drill string. Step 215 is inserting the drill string into a borehole. Step 220 is operating the drill string, including rotation and applying axial forces (weight-on-bit), thereby generating shocks and rotation experienced by the tool. Step 225 is the shock source transmitting the shock to the second end of the shock isolator device and the second end receiving that shock. Step 230 is moving a dampener section, containing a viscous damper with an oil-filled cylindrical bore, relative to a piston assembly with lower and upper axial springs, the piston assembly being axially fixed to the plunger. Step 232 is a spline key, axially fixed to the plunger and engaged with a sleeve spline on the interior of an outer main sleeve of the anti-rotation system, and within a main cavity of the main sleeve, moving axially relative to the sleeve spline and main sleeve. Step 235 is compressing one of the axial springs between the piston and a shoulder. Step 237 is compressing the oil in the cylindrical bore on one side of the piston. Step 240 is forcing the oil through a damper orifice to the other side of the piston and cylindrical bore. Step 245 is dissipating energy from the shock by generating heat losses by the oil being passed through the orifice. Step 250 is attenuating axial shock to the protected mass. Step 255 is the shock source transmitting the rotation to the second end of the shock isolator device. Step 260 is rotating the outer main sleeve, including a sleeve spline, of the anti-rotation system with the rotation of the shock source. Step 265 is rotating a spline key, with an exterior spline and interior spline, with that outer main sleeve, the spline key meshed within and to the outer main sleeve. Step 270 is rotating a plunger, including a plunger spline, with that spline key, the plunger meshed within and to the spline key. Step 275 is transmitting the rotation to the first end of the shock isolator device. Step 280 is rotating the protected mass with the first end of the shock isolator device. Step 285 is the meshed main sleeve, spline key, and plunger resisting torsional forces arising from rotational inertia tending to further rotate or oscillate the protected mass. Step 290 is maintaining the rotational orientation of the protected mass to the shock source.

Figure 8:
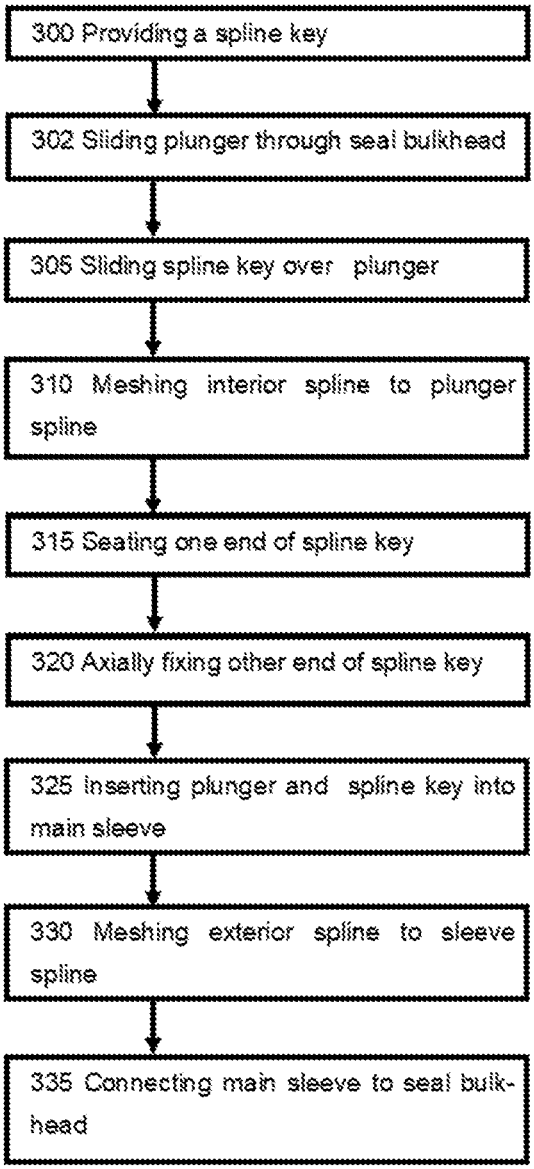
FIG. 8 describes a method of assembly of an embodiment of the shock isolation device.

Turning to FIG. 8, an embodiment of a method of assembly of the invention includes the following steps. Step 300 is providing a spline key with an interior spline, having a plurality of spline projections facing the interior thereof, and an exterior spline of the spline key, having a plurality of spline projections facing the exterior of the spline key, and a cylindrical core connecting the interior spline and exterior spline. Step 302 is sliding a plunger through a hole on the bottom end of a seal bulkhead. Step 305 is sliding the interior spline of the spline key over a plunger spline on the plunger, the plunger spline having a plurality of radially-outward plunger spline slots. Step 310 is fully meshing the interior spline to the plunger spline, including seating opposing bearing faces of the interior spline to opposing bearing faces of the plunger spline. Step 315 is seating one end of the spline key on a shoulder. Step 320 is then axially fixing the other end to the plunger by a snap ring or other locking device. Step 325 is then inserting the plunger and the exterior spline of the spline key into sleeve spline of a main sleeve, the sleeve spline having a plurality of radially-inward sleeve spline slots. Step 330 is fully meshing the exterior spline to the sleeve spline, including seating opposing bearing faces to opposing bearing faces of the exterior spline and the sleeve spline. Step 335 is connecting the main sleeve to the seal bulkhead to rotationally and axially fix one to another, e.g. by threading them together.

Figure 9:
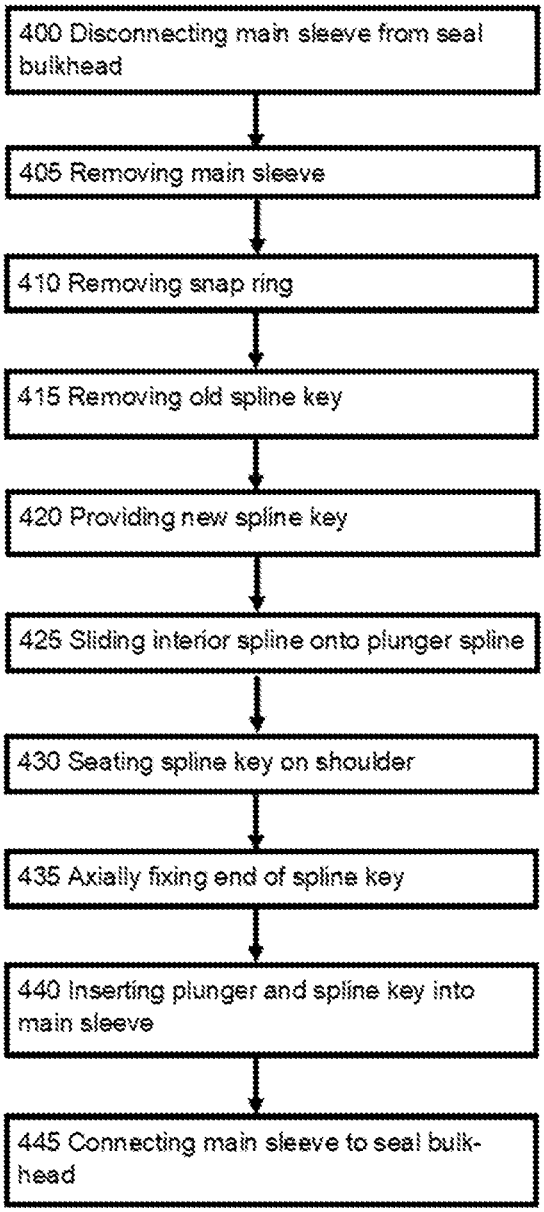
FIG. 9 describes a method of repair of an embodiment of the shock isolation device.

Turning to FIG. 9, an embodiment of a method of repair/maintenance of an anti-rotation tool of a shock isolator device includes the following steps. Step 400 is disconnecting a main sleeve from a seal bulkhead, e.g. by unthreading it. Step 405 is removing the main sleeve by sliding the radially-inward sleeve spline thereof off of a radially-outward exterior spline of an old spline key to expose the old spline key and plunger. Step 410 is then removing a snap ring (or other axial-fixing structure) retaining the old spline key on the plunger. Step 415 is then removing the old spline key by sliding a radially-inward interior spline of the old spline key off of a radially-outward plunger spline of the plunger. Step 420 is providing a new spline key with a radially-inward interior spline, and a radially-outward exterior spline, and that is less wear-resistant than the main sleeve. Step 425 is then sliding the interior spline of the new spline key onto the plunger spline of the plunger. Step 430 is seating one end of the spline key on a shoulder. Step 435 is then axially fixing the other end to the plunger by a snap ring or other locking device. Step 440 is then inserting the plunger and the exterior spline of the spline key into the sleeve spline of the main sleeve. Step 445 is connecting the main sleeve to the seal bulkhead to rotationally and axially fix one to another, e.g. by threading them together.

The invention claimed is:

1. A shock isolator device configured for incorporation into a drilling system in an environment experiencing shocks along a longitudinal axis and torsional forces about the longitudinal axis, the device comprising:

a main sleeve having a main cavity therein;

a plunger configured to move at least partly within said main cavity;

a spline key;

said spline key comprising an interior spline and an exterior spline;

said spline key engaged with said main sleeve and said plunger; and a shock damper connecting said main sleeve and said plunger and damping longitudinal shock therebetween; and wherein the spline key does not permit axial rotation of the plunger relative to the main sleeve.

2. The shock isolator device of claim 1, said main sleeve further comprising a sleeve spline extending into said main cavity;

said plunger further comprising a plunger spline;

said interior spline engaging said plunger spline; and said exterior spline engaging said sleeve spline.

3. The shock isolator device of claim 1, said plunger further comprising a plunger connector end and a sleeve end;

said plunger further comprising a channel extending axially between the plunger connector end and the sleeve end.

4. The shock isolator device of claim 3, said plunger further comprising a first hydraulic connection on said plunger connector end;

said shock damper comprising a second hydraulic connection; and said shock damper forming a hydraulic connection along said channel and between said first and second hydraulic connections.

5. The shock isolator device of claim 1, said interior spline comprising a plurality of interior spline projections;

each of said plurality of interior spline projections having two opposing interior bearing faces; and said opposing interior bearing faces being substantially parallel to one other.

6. The shock isolator device of claim 5, said exterior spline comprising a plurality of exterior spline projections;

each of said plurality of exterior spline projections having opposing exterior bearing faces; and said opposing exterior bearing faces being substantially parallel to each other.

7. The shock isolator device of claim 5, said main sleeve further comprising a sleeve spline extending into said main cavity;

said sleeve spline comprising a plurality of sleeve spline slots;

each of said plurality of sleeve spline slots having two opposing sleeve bearing faces; and said opposing sleeve bearing faces being substantially parallel to one other;

said plunger further comprising a plunger spline;

said plunger spline comprising a plurality of plunger spline slots;

each of said plurality of plunger spline slots having two opposing plunger bearing faces; and said opposing plunger bearing faces being substantially parallel to one other.

8. The shock isolator device of claim 1, each of said interior spline and said exterior spline comprising a plurality of sets of flat bearing faces;

each set of the plurality of sets of bearing faces comprising a first bearing face substantially parallel to a second bearing face.

9. The shock isolator device of claim 1, said spline key further comprising a cylindrical core;

said cylindrical core connecting said interior spline and exterior spline.

10. The shock isolator device of claim 1, the shock damper comprising a spring assembly and a viscous damper.

11. An MWD tool, incorporating the shock isolator device of claim 1.

12. A shock isolator device configured for incorporation into a drilling system in an environment experiencing shocks along a longitudinal axis and torsional forces about the longitudinal axis, the device comprising:

a main sleeve having a main cavity therein;

a plunger configured to move at least partly within said main cavity;

a spline key;

said spline key comprising an interior spline and an exterior spline;

said spline key engaged with said main sleeve and said plunger; and a shock damper connecting said main sleeve and said plunger and damping longitudinal shock therebetween;

said plunger further comprising a plunger connector end and a sleeve end;

said plunger further comprising a channel extending axially between the plunger connector end and the sleeve end;

said channel comprising an electronics pathway between the plunger connector end and the sleeve end;

said plunger connector end and said sleeve end each comprising a plug; and said plunger further comprising a wire assembly connecting said plugs.

13. A shock isolator device configured for incorporation into a drilling system in an environment experiencing shocks along a longitudinal axis and torsional forces about the longitudinal axis, the device comprising:

a main sleeve having a main cavity therein;

a plunger configured to move at least partly within said main cavity;

a spline key;

said spline key comprising an interior spline and an exterior spline;

said spline key engaged with said main sleeve and said plunger; and a shock damper connecting said main sleeve and said plunger and damping longitudinal shock therebetween;

each of said interior spline and said exterior spline comprising a plurality of sets of flat bearing faces;

each set of the plurality of sets of bearing faces comprising a first bearing face substantially parallel to a second bearing face;

wherein the first bearing face of at least one of the sets of bearing faces of said interior spline is substantially parallel to the first bearing face of at least one of the sets of bearing faces of said exterior spline.

14. A method of attenuating shocks from a shock source, along a longitudinal axis, and resisting torsional forces, about the longitudinal axis, to a protected mass in a drilling system, comprising:

fixing a protected mass to a first end of a shock isolator device at a rotational orientation; and receiving an axial shock at a second end of the shock isolator device;

said shock isolator device comprising a main sleeve having a main cavity therein;

a plunger configured to move at least partly within said main cavity;

a spline key;

said spline key comprising an interior spline and an exterior spline;

said spline key engaged with said main sleeve and said plunger; and a shock damper connecting said main sleeve and said plunger; and damping longitudinal shock between the first end and second end; and maintaining the rotational orientation of the protected mass.

15. The method of claim 14, the maintaining step comprising:

rotating the main sleeve with the shock source;

rotating the spline key with the main sleeve;

rotating the plunger with the spline key; and rotating the protected mass with the plunger.

16. The method of claim 15, the maintaining step further comprising the main sleeve, spline key, and plunger, resisting torsional forces arising from rotational inertia tending to further rotate or oscillate the protected mass.

17. The method of claim 14, the maintaining step comprising the spline key restricting the plunger from axial rotation relative to the main sleeve.

18. The method of claim 14, the damping step comprising:

moving the shock damper axially relative to the plunger;

said moving the shock damper comprising a piston in said shock damper compressing oil in a cylindrical bore in said shock damper.

19. The method of claim 14, the damping step comprising:

moving the main sleeve axially relative to the spline key;

wherein said spline key is axially fixed on said plunger.

20. The method of claim 14, the damping step comprising:

moving the main sleeve axially relative to the spline key;

the main sleeve further comprising a sleeve spline extending into said main cavity;

said plunger further comprising a plunger spline;

said interior spline engaging said plunger spline; and said exterior spline engaging said sleeve spline.

21. The method of claim 14, wherein the protected mass is selected from group consisting of an instrument section, a battery section, a servo pulser, and an EM transmitter assembly.

22. A method of repairing a shock isolator device for incorporation into a drilling system, comprising:

providing a spline key;

said spline key comprising an interior spline and an exterior spline;

said interior spline and an exterior spline each being axially-aligned;

engaging said spline key with a plunger; and engaging said spline key with a main sleeve;

said main sleeve having a main cavity therein; and said plunger configured to move at least partly within said main cavity; and connecting said main sleeve and said plunger with a shock damper.

23. The method of claim 22, said plunger further comprising a plunger spline;

said step of engaging said spline key with the plunger comprising said interior spline engaging said plunger spline;

said main sleeve further comprising a sleeve spline extending into said main cavity; and said step of engaging said spline key with the main sleeve comprising said exterior spline engaging said sleeve spline.

24. The method of claim 22:

each of said interior spline and said exterior spline comprising a plurality of sets of flat bearing faces; and each set of bearing faces comprising a first bearing face substantially parallel to a second bearing face.

25. The method of claim 22, said spline key being less wear-resistant than said main sleeve.

26. The method of claim 22, said spline key further comprising a cylindrical core;

said cylindrical core connecting said interior spline and exterior spline.

27. A method of repairing a shock isolator device for incorporation into a drilling system, comprising:

providing a spline key;

said spline key comprising an interior spline and an exterior spline;

engaging said spline key with a plunger; and engaging said spline key with a main sleeve;

said main sleeve having a main cavity therein; and said plunger configured to move at least partly within said main cavity;

connecting said main sleeve and said plunger with a shock damper;

seating a first end of the spline key on a shoulder; and fixing said spline key axially on said plunger before engaging said spline key with the main sleeve.

28. A method of repairing a shock isolator device for incorporation into a drilling system, comprising:

providing a spline key;

said spline key comprising an interior spline and an exterior spline;

engaging said spline key with a plunger; and engaging said spline key with a main sleeve;

said main sleeve having a main cavity therein; and said plunger configured to move at least partly within said main cavity;

connecting said main sleeve and said plunger with a shock damper;

each of said interior spline and said exterior spline comprising a plurality of sets of flat bearing faces; and each set of bearing faces comprising a first bearing face substantially parallel to a second bearing face; and wherein the first bearing face of at least one of the sets of bearing faces of said interior spline is substantially parallel to the first bearing face of at least one of the sets of bearing faces of said exterior spline.

29. A shock isolator device configured for incorporation into a drilling system in an environment experiencing shocks along a longitudinal axis and torsional forces about the longitudinal axis, the device comprising:

a main sleeve having a main cavity therein;

a plunger configured to move at least partly within said main cavity;

a spline key;

said spline key comprising an interior spline and an exterior spline;

said spline key engaged with said main sleeve and said plunger; and a shock damper connecting said main sleeve and said plunger and damping longitudinal shock therebetween; and said spline key axially fixed on said plunger.

30. The shock isolator device of claim 29, wherein the spline key restricts the plunger from axial rotation relative to the main sleeve.

31. The shock isolator device of claim 29, said spline key being less wear-resistant than said main sleeve.

* * * * *